US008246306B2

(12) United States Patent
Schotsch et al.

(10) Patent No.: US 8,246,306 B2
(45) Date of Patent: Aug. 21, 2012

(54) AIRFOIL FOR NOZZLE AND A METHOD OF FORMING THE MACHINED CONTOURED PASSAGE THEREIN

(75) Inventors: Margaret Jones Schotsch, Greer, SC (US); Randall Gill, Greenville, SC (US); Peter Stevens, Simpsonville, SC (US); David Leo, Leominster, MA (US); John Seymour, Harvard, MA (US)

(73) Assignee: General Electric Company, Schenectady, NY (US)

( * ) Notice: Subject to any disclaimer, the term of this patent is extended or adjusted under 35 U.S.C. 154(b) by 1432 days.

(21) Appl. No.: 12/062,123

(22) Filed: Apr. 3, 2008

(65) Prior Publication Data

US 2009/0252603 A1 Oct. 8, 2009

(51) Int. Cl.
*F01D 5/08* (2006.01)

(52) U.S. Cl. ..... 416/96 R; 415/115

(58) Field of Classification Search ..... 415/115; 416/96 R, 97 R

See application file for complete search history.

(56) References Cited

U.S. PATENT DOCUMENTS 3,191,908 A * 6/1965 Petrie et al. ..... 416/96 R
3,806,275 A * 4/1974 Aspinwall ..... 416/97 R
4,672,727 A 6/1987 Field
5,462,405 A 10/1995 Hoff et al.
5,609,779 A 3/1997 Crow et al.
6,056,508 A * 5/2000 Johnson et al. ..... 416/96 R
6,099,251 A 8/2000 LaFleur
6,102,658 A 8/2000 Kvasnak et al.
6,213,714 B1 4/2001 Rhodes
6,388,223 B2 5/2002 Jones et al.
6,517,312 B1 * 2/2003 Jones et al. ..... 415/115
6,717,095 B2 4/2004 Arness et al.
6,835,046 B2 12/2004 Strassberger et al.
6,969,230 B2 11/2005 Shi et al.
7,134,842 B2 11/2006 Tam et al.
7,249,934 B2 7/2007 Palmer et al.
7,303,376 B2 12/2007 Liang
2006/0042084 A1 3/2006 Hudson et al.
2009/0148280 A1 * 6/2009 Schilp ..... 415/177

* cited by examiner

*Primary Examiner* — Edward Look
*Assistant Examiner* — Aaron R Eastman
(74) *Attorney, Agent, or Firm* — Cantor Colburn LLP

(57) ABSTRACT

A nozzle in which an airfoil includes a pressure surface and a suction surface that join at substantially opposing chordal ends of the airfoil to form a leading edge of the airfoil and a trailing edge of the airfoil. A trailing edge passage is defined through the airfoil through which coolant flows. The trailing edge passage is proximate to the trailing edge of the airfoil and has a contoured shape that conforms to that of the trailing edge.

13 Claims, 3 Drawing Sheets

AIRFOIL FOR NOZZLE AND A METHOD OF FORMING THE MACHINED CONTOURED PASSAGE THEREIN

BACKGROUND OF THE INVENTION

This application is directed to a machined contoured passage for airfoil trailing edge (TE) cooling and, more particularly, to a machined contoured passage for airfoil TE cooling in which the contoured passage mimics a shape of the airfoil TE.

Recently, it has been observed that a passage that extends through a trailing edge (TE) of a nozzle airfoil may be employed to cool the TE during use of the airfoil in, e.g., a turbine engine. The cooling process involves forcing a coolant, such as water or steam at high pressure, through the passage. Typically, however, nozzle design involves high temperatures that heat the TE and therefore require that the TE have thin walls that may be cooled from an interior of the airfoil. As such, the combination of the thin wall requirement, the high external temperatures and the high internal pressure require the TE cooling passage to be very small and the walls of the TE cooling passage to have certain dimensions and thicknesses.

While casting technology is generally employed to produce the TE passage of the nozzle airfoil, casting cannot reliably form the TE passage at the small sizes that may be necessary for proper performance of the nozzle and the nozzle airfoil. That is, casting processes are experimental for small TE passages and have inherent problems with the maintenance of wall thicknesses thereof.

BRIEF DESCRIPTION OF THE INVENTION

In accordance with an aspect of the invention, a nozzle is provided and includes an airfoil including a pressure surface and a suction surface that join at substantially opposing chordal ends thereof to form a leading edge of the airfoil and a trailing edge of the airfoil, and a wall portion of the airfoil to define a trailing edge passage extending through the airfoil proximate to the trailing edge through which coolant can flow, the wall portion having a substantially uniform thickness such that the trailing edge of the airfoil is defined with a contoured shape that conforms to that of the trailing edge.

In accordance with another aspect of the invention, a nozzle is provided and includes at least one pair of opposing platforms, and at least one airfoil disposed between each pair of the platforms, the at least one airfoil including a wall having a pressure surface and a suction surface that join at substantially opposing chordal ends of the airfoil to form a leading edge of the airfoil and a portion of the wall to define a trailing edge passage extending through the airfoil proximate to the trailing edge through which coolant can flow, the portion of the wall having a substantially uniform thickness such that the trailing edge of the airfoil is defined with a contoured shape that conforms to that of the trailing edge.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
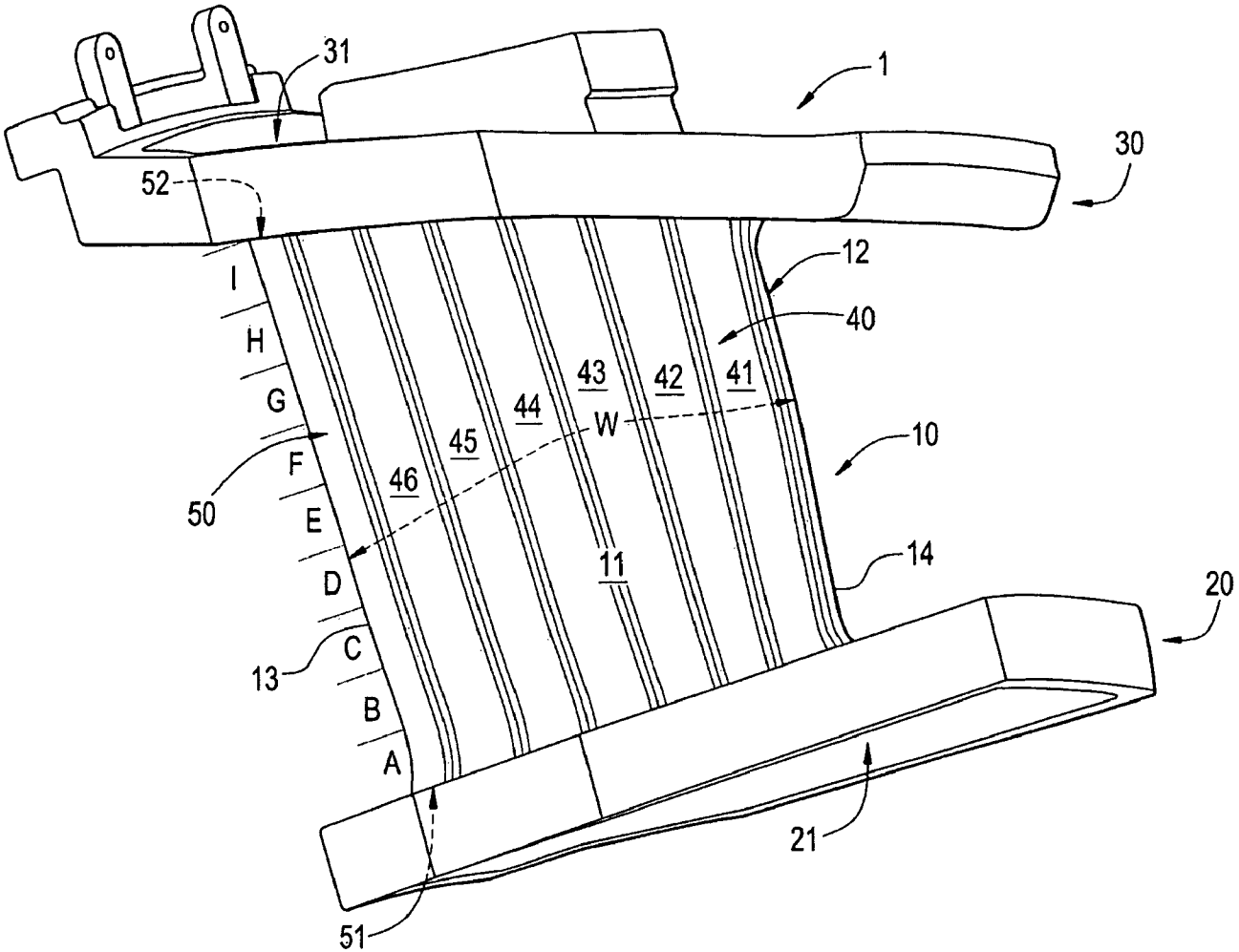
FIG. 1 is a sectional view of a nozzle airfoil in accordance with an exemplary embodiment of the invention.

Referring to FIG. 1, a nozzle segment 1 of a turbine or other similar machine includes an airfoil 10 that is disposed between sections of inner and outer sidewalls 20 and 30 which generally face one another. Although not shown, it is understood that the nozzle segment 1 may form one of a plurality of nozzle segments 1 arranged in an array thereof about an axis to form, e.g., a nozzle stage of a turbine with the inner and outer sidewalls 20 and 30, respectively, forming portions of the inner and outer bands of the nozzle stage. Also, while a single airfoil 10 is illustrated between the inner and outer sidewalls 20 and 30, it is understood that two or more airfoils 10 may be disposed between the inner and outer sidewalls 20 and 30.

As shown in FIG. 1, the airfoil 10 includes a pressure surface 12 and a suction surface 11 on opposing surfaces of the airfoil 10. The pressure surface 12 and the suction surface 11 join at substantially opposing chordal ends of the airfoil (see the chord-line, W, in FIGS. 1 and 3A) to form a leading edge 14 and a trailing edge 13 of the airfoil 10. Further, the airfoil is bowed about a radial axis of the nozzle 1 where the radial axis is defined as extending substantially in parallel with the trailing edge 13. Here, the pressure surface 12 spans an exterior of the bow while the suction surface 11 spans an interior of the bow.

The inner and outer side walls 20 and 30 have internal cavities 21 and 31, respectively. Similarly, the airfoil 10 has a main internal cavity section 40 and a trailing edge passage 50 defined in an interior thereof. While the trailing edge passage 50 is a single feature, the main internal cavity section 40 may further include about 6 internal cavities 41, 42, 43, 44, 45 and 46. Here, the internal cavities 41-46 and the trailing edge passage 50 may each include an inlet 51 and an outlet 52 (shown in FIG. 1 for trailing edge passage 50), which could allow the internal cavities 41-46 and the trailing edge passage 50 to communicate with the internal cavities 21 and 31 of the inner and outer sidewalls 20 and 30. Of course, it is understood that not all of the internal cavities 41-46 are required to be designed in this manner.

In this capacity, the internal cavities 41-46 and the trailing edge passage 50 each may provide a passageway for coolant, such as steam or water, to flow between the internal cavities 21 and 31 of the inner and outer sidewalls 20 and 30. These passageways may or may not contain turbulators in accordance with desired flow characteristics. The coolant cools the airfoil 10 and the inner and outer side walls 20 and 30, which are exposed to high temperatures during operation of the nozzle segment 1.

Figure 2:
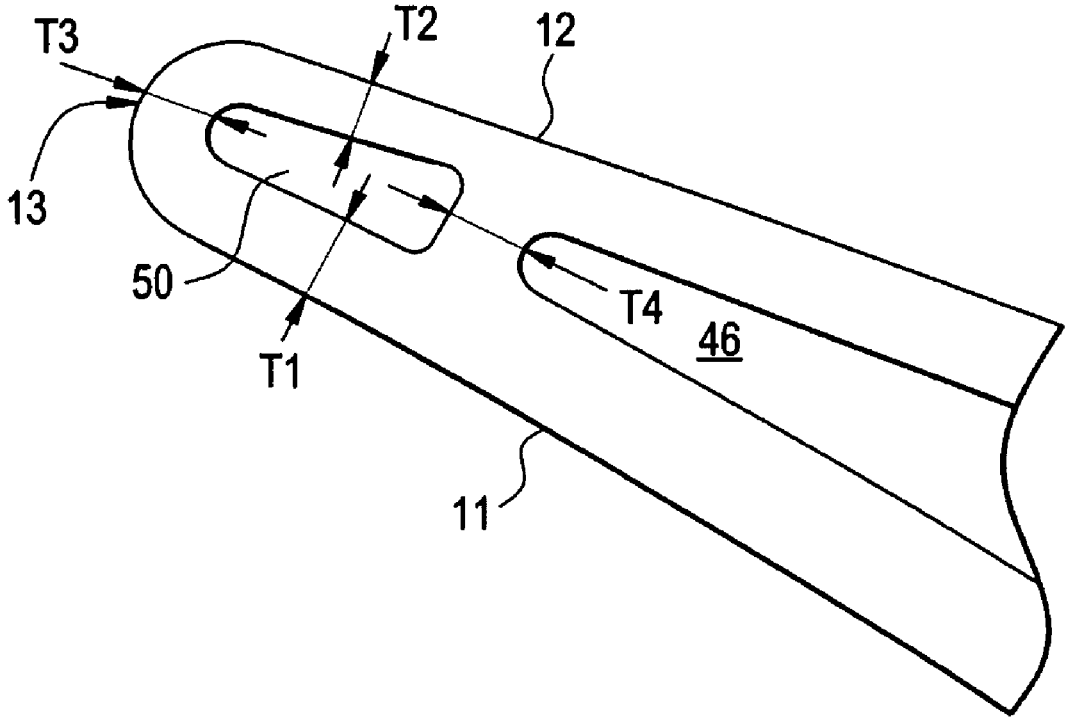
FIG. 2 is a cross-sectional view of a trailing edge of an airfoil in accordance with an exemplary embodiment of the invention.

With reference now to FIGS. 1 and 2, it is noted that the trailing edge 13 of the airfoil 10 is located at the thinnest portion of the airfoil 10 and that the trailing edge passage 50 conforms to a shape of the trailing edge 13 such that a wall thickness of the pressure surface 12 and the suction surface 11 is substantially consistent. That is, at least portions of the pressure surface 12, the suction surface 11 and the trailing edge 13 each have wall thicknesses of between about 0.104 cm (+/−0.03) cm to about 0.155 (+/−0.02) cm.

In detail, it is noted that the wall thickness may be measured at points corresponding to thicknesses T1, T2 and T3 of the airfoil 10 at or proximate to the trailing edge 13 and at various cross-sections of the airfoil 10. Such measurements, in centimeters, have been conducted for exemplary embodiments 1 and 2 for cross-sections A-I of FIG. 1 and have revealed the following:

| | T1 (+/−0.03) | | T2 (+/−0.03) | | T3 (+/−0.02) | |
|---|---|---|---|---|---|---|
| Section | Emb. 1 | Emb. 2 | Emb. 1 | Emb. 2 | Emb. 1 | Emb. 2 |
| A | 0.122 | 0.119 | 0.145 | 0.117 | 0.147 | 0.127 |
| B | 0.117 | 0.122 | 0.145 | 0.130 | 0.147 | 0.130 |
| C | 0.117 | 0.124 | 0.145 | 0.132 | 0.155 | 0.132 |
| D | 0.117 | 0.130 | 0.150 | 0.124 | 0.147 | 0.132 |
| E | 0.112 | 0.130 | 0.145 | 0.124 | 0.147 | 0.135 |
| F | 0.112 | 0.132 | 0.150 | 0.122 | 0.150 | 0.132 |
| G | 0.109 | 0.130 | 0.150 | 0.122 | 0.150 | 0.132 |
| H | 0.104 | 0.132 | .0.145 | 0.124 | 0.152 | 0.135 |
| I | 0.124 | 0.127 | 0.137 | 0.124 | 0.152 | 0.135 |

That is, the portion of the wall along the suction surface 11 has a wall thickness, T1, of between about 0.104 (+/−0.03) cm to about 0.132 (+/−0.03) cm, the portion of the wall along the pressure surface 12 has a wall thickness, T2, of between about 0.117 (+/−0.03) cm to about 0.150 (+/−0.03) cm, and the portion of the wall around the trailing edge 13 has a wall thickness, T3, of between about 0.127 (+/−0.02) cm to about 0.155 (+/−0.02) cm.

Still referring to FIG. 2, it is noted that a thickness, T4, of an interior portion of the airfoil 10 between the trailing edge passage 50 and an adjacent internal cavity 46 is maintained substantially consistently along the span of the airfoil 10. That is, in an embodiment of the invention, the thickness, T4, is between about 0.251 (+/−0.03) cm to about 0.284 (+/−0.03) cm.

Figure 3C:
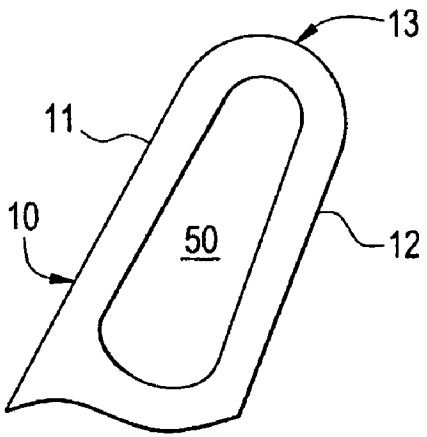
FIGS. 3A, 3B and 3C illustrate a method of forming the trailing edge passage in accordance with an exemplary embodiment of the invention.
Figure 3B:
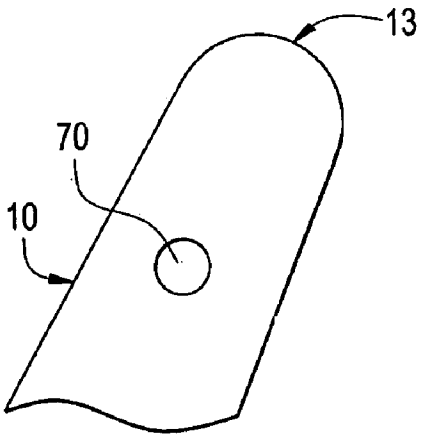
Figure 3A:
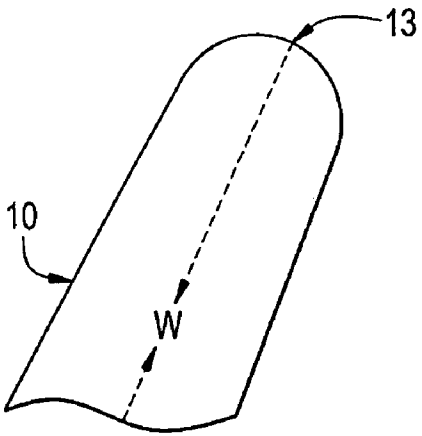

With reference to FIGS. 3A-3C in accordance with another aspect of the invention, a method of forming a trailing edge passage 50 to provide for a cooling of a trailing edge 13 of an airfoil 10 includes casting a body of an airfoil 10 with a trailing edge 13 and temporarily flattening the airfoil 10 in, e.g., a direction perpendicular to a chordal direction (along line, W, of FIGS. 1 and 3A) of the airfoil 10 and in opposition to a bow of the airfoil. A pilot hole 70 as shown in FIG. 3B, is then drilled into a region of the airfoil 10 proximate to the trailing edge 13. Here, the pilot hole 70 may be drilled by, e.g., an electrochemical (ECM) drilling process.

Once the pilot hole 70 is drilled, an electro-displacement machining (EDM) process wire is inserted into the pilot hole 70. The EDM process wire is then tracked within the pilot hole 70 so as to remove material around the pilot hole 70 from the body of the airfoil 10. This process forms the trailing edge passage 50, as shown in FIG. 3C, as a contoured passage having a shape that conforms to a shape of the trailing edge 13. Once the trailing edge passage 50 is formed, the pressure required to temporarily flatten the bow of the airfoil 10 is released.

In accordance with various embodiments of the invention, the casting may include forming internal cavities 41-46 within the airfoil 10 and forming internal cavities 21 and 31 within the inner and outer side walls 20 and 30. Moreover, once the internal cavities 41-46 and the trailing edge passage 50 are formed, a level of airflow through the internal cavities 41-46 and the trailing edge passage 50 is checked.

This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A nozzle comprising:

at least one pair of opposing platforms; and at least one airfoil disposed between each pair of the platforms, the at least one airfoil including:

a wall having a pressure surface and a suction surface that join at substantially opposing chordal ends of the airfoil to form a leading edge of the airfoil and a trailing edge of the airfoil, and a portion of the wall to define a trailing edge passage extending through the airfoil proximate to the trailing edge through which coolant can flow, the portion of the wall having a substantially uniform thickness such that the trailing edge of the airfoil is defined with a contoured shape that conforms to that of the trailing edge, wherein the trailing edge passage does not include turbulators therein.

2. The nozzle according to claim 1, wherein the opposing platforms respectively comprise sections of an inner side wall and an outer side wall of the nozzle.

3. The nozzle according to claim 1, wherein:

a radial axis of the nozzle is defined as extending substantially in parallel with the trailing edge of the airfoil, and the airfoil is at least partially bowed about the radial axis of the nozzle.

4. The nozzle according to claim 1, wherein the opposing platforms each comprise internal cavities that communicate with the trailing edge passage.

5. The nozzle according to claim 4, wherein the airfoil comprises internal cavities disposed in a main internal cavity section of the airfoil that each communicate with the internal cavities of the opposing platforms.

6. The nozzle according to claim 5, wherein at least a portion of the internal cavities of the airfoil and the trailing edge passage of the airfoil each communicate with the internal cavities of the opposing platforms via respective inlets and outlets defined therein.

7. The nozzle according to claim 1, wherein the portion of the wall extends along respective portions of the suction surface and the pressure surface and around the trailing edge.

8. The nozzle according to claim 1, wherein the airfoil is tapered in a direction leading to the trailing edge thereof.

9. The nozzle according to claim 8, wherein the trailing edge passage is wedge-shaped in accordance with the taper of the airfoil.

10. The nozzle according to claim 1, wherein the opposing platforms each comprise cast materials, and wherein the airfoil comprises cast materials in which the trailing edge passage is machined.

11. The nozzle according to claim 10, wherein the cast materials of the opposing platforms and the cast materials of the airfoil are configured to be integrally combined with each other.

12. The nozzle according to claim 1, wherein the trailing edge passage is configured to prevent coolant egress from the trailing edge passage.

13. The nozzle according to claim 1, wherein the trailing edge passage is configured to prevent coolant egress via the trailing edge from the trailing edge passage.

* * * * *